US007757714B2

(12) United States Patent
Meinhof

(10) Patent No.: US 7,757,714 B2
(45) Date of Patent: Jul. 20, 2010

(54) TWO-STAGE SERVO-VALVE

(75) Inventor: Andre-Heinrich Meinhof, Rheinstetten (DE)

(73) Assignee: Siemens Aktiengesellschaft, Munich (DE)

( * ) Notice: Subject to any disclaimer, the term of this patent is extended or adjusted under 35 U.S.C. 154(b) by 760 days.

(21) Appl. No.: 11/664,740

(22) PCT Filed: Oct. 5, 2005

(86) PCT No.: PCT/EP2005/055030

§ 371 (c)(1),
(2), (4) Date: Apr. 5, 2007

(87) PCT Pub. No.: WO2006/037793

PCT Pub. Date: Apr. 13, 2006

(65) Prior Publication Data

US 2008/0066814 A1 Mar. 20, 2008

(30) Foreign Application Priority Data

Oct. 6, 2004 (DE) ..... 10 2004 048 689

(51) Int. Cl.
*F15B 13/042* (2006.01)

(52) U.S. Cl. ..... 137/625.61; 137/625.6; 251/25

(58) Field of Classification Search ..... 137/625.6, 137/625.61, 625.62, 625.66; 251/25, 26, 251/28

See application file for complete search history.

(56) References Cited

U.S. PATENT DOCUMENTS 1,913,516 A * 6/1933 Sharp ..... 251/26
2,605,079 A * 7/1952 Miller ..... 137/625.66
2,886,009 A * 5/1959 Myers ..... 137/625.62
2,924,241 A * 2/1960 Bauer ..... 137/625.62
2,941,515 A * 6/1960 Garnjost ..... 137/625.62
3,282,552 A * 11/1966 Sommese, Sr ..... 251/26
3,712,339 A * 1/1973 Bartholomaus et al. 137/625.62
3,814,375 A * 6/1974 Grotloh ..... 251/28
4,014,509 A * 3/1977 Yoshino et al. ..... 251/26
4,319,609 A * 3/1982 Debrus ..... 137/625.63
4,852,850 A * 8/1989 Wilhelm et al. ..... 251/28
4,883,091 A * 11/1989 Weiler et al. ..... 137/625.62
7,631,663 B2 * 12/2009 Rauch et al. ..... 137/625.62

FOREIGN PATENT DOCUMENTS

DE 38 02 917 A1 8/1988
DE 41 35 822 A1 8/1992
DE 42 01 442 A1 1/1995
EP 0 943 812 A1 9/1999
WO WO 03/100264 A1 12/2003
WO WO 2005/077731 A1 8/2005

* cited by examiner

*Primary Examiner*—John Rivell

(57) ABSTRACT

A two-stage servo-valve has a first stage in which four flow resistances are arranged in a bridge circuit. At least one of the flow resistances is variable, and two opposite switching points of the bridge circuit are connected to an air inlet and to an air outlet respectively. A differential pressure of variable size and sign is provided between the two other switching points. The servo-valve also has a second stage in which a control piston which can be actuated by the differential pressure is arranged and controls a three-way valve. In order to enable the current position of a process valve driven by the servo-valve to be maintained by the most simple means in the event of a power failure, the switching points which provide the differential pressure are interconnected by a magnetic valve which is closed in the driven state and open in the unconnected state, thus pneumatically interconnecting the switching points.

6 Claims, 1 Drawing Sheet

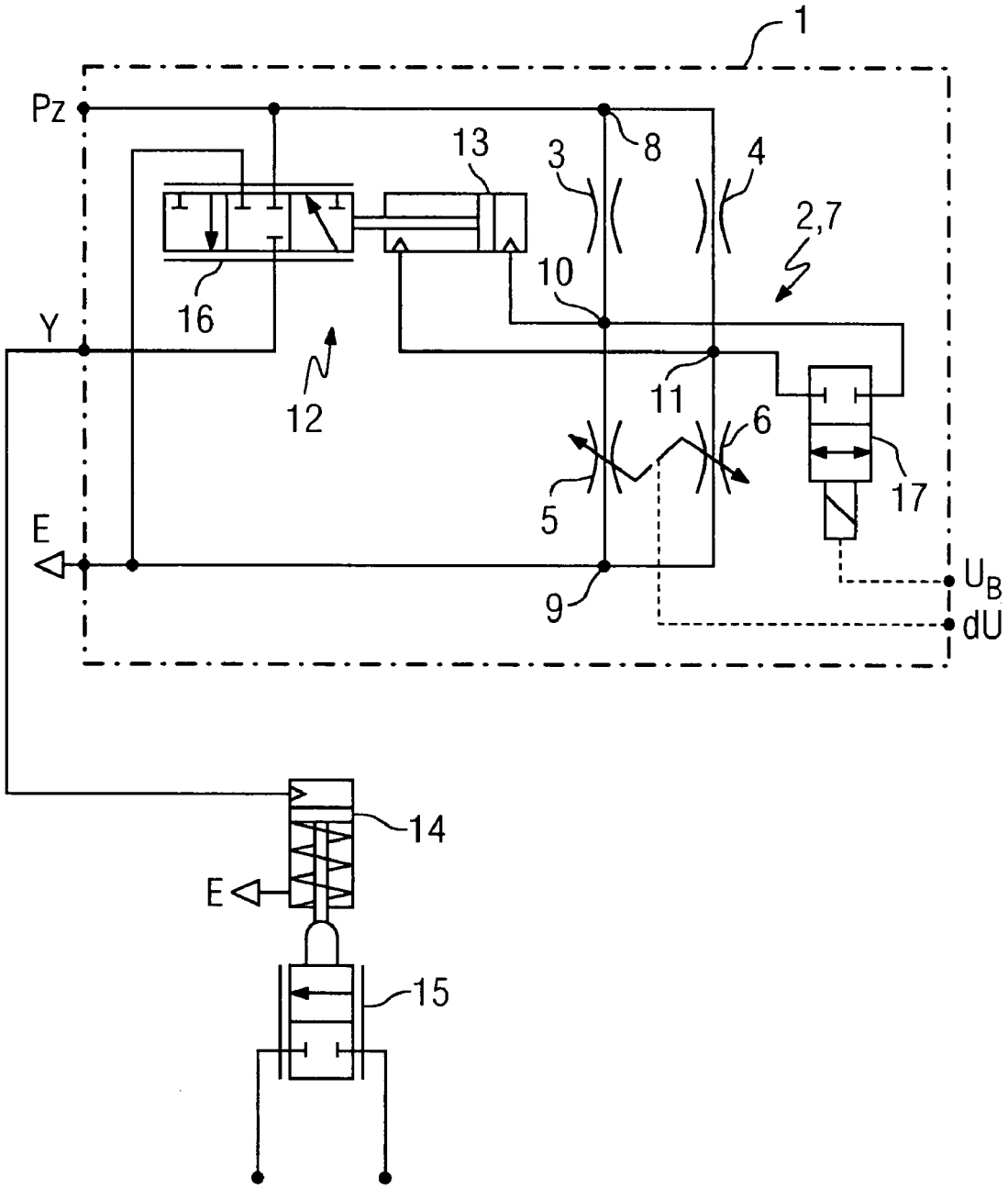
1
Pz
13
3
8
4
2,7
10
16
Y
12
11
6
5
17
E
9
$U_B$
dU
14
E
15

TWO-STAGE SERVO-VALVE

CROSS REFERENCE TO RELATED APPLICATIONS

This application is the US National Stage of International Application No. PCT/EP2005/055030, filed Oct. 5, 2005 and claims the benefit thereof. The International Application claims the benefits of German application No. 10 2004 048 689.1 DE filed Oct. 6, 2004, both of the applications are incorporated by reference herein in their entirety.

FIELD OF INVENTION

The invention relates to a two-stage servo-valve having a first stage in which four flow resistances are arranged in a bridge circuit, at least one flow resistance of which is variable and two opposite switching points of the bridge circuit are connected to an air inlet and to an air outlet and a differential pressure of variable size and sign is provided between the two other switching points. The servo-valve also has a second stage in which a control piston which can be actuated by the differential pressure is arranged and controls a three-way valve.

BACKGROUND OF INVENTION

A servo-valve of this type and known from DE 41 35 822 A1 contains up to four individual piezo-valves in a first stage, all four piezo-valves, or in the case of a lower number together with fixed resistances, being arranged in a bridge circuit. Each piezo-valve contains its own actuatable piezo-element, which, together with a deflector, forms a controllable flow resistance. The bridge circuit serves to generate a differential pressure of variable size and sign, with which, in a further stage of the servo-valve, a control piston can be adjusted and a three-way valve can be adjusted by way of said control piston, said three-way valve serving to adjust a hydraulic cylinder.

Alternative designs of piezo-valves are known from EP 0 943 812 A1 or the subject matter of the former German patent application with the official file reference 10 2004 035 844.3.

Instead of piezo-valves, electromagnetic or any other electrically actuatable valves can also be used in the bridge circuit.

DE 42 01 442 A1 shows an alternative embodiment of the three-way valve, which, in a known manner, can also be configured as a slide valve, rotary valve or can consist of individual valves such as for instance check valves.

Servo-valves are used in many areas of technology, thus also with electro-pneumatic positioners, which serve to control the drive of process valves. In the event of a power failure, a request is often made for the drive actuated by the positioner to automatically bring the process valve into a secure position, generally "open" or "close".

SUMMARY OF INVENTION

An object underlying the invention is to enable the current position of the process valve driven by the servo-valve to be maintained using the simplest means in the event of a power failure.

In accordance with the invention, the object is achieved in that in the case of the servo-valve of the type specified at the start, the switching points providing the differential pressure are interconnected by way of a magnetic valve, said magnetic valve being closed in the driven state and open in the unconnected state, thus pneumatically interconnecting the switching points.

In the event of a power failure, the magnetic valve opens and thus briefly pneumatically closes the exit of the bridge circuit and/or the two hydraulic sides of the control piston. As a consequence, the three-way valve adopts the center position (rest position), which enables the process valve drive which can be connected thereto to be maintained in the current position. Furthermore, the servo-valve according to the invention is described with reference to one of the exemplary embodiments illustrated in the sole FIGURE of the drawings.

BRIEF DESCRIPTION OF THE DRAWING

A sole FIGURE shows an example of a two-stage servo-valve.

DETAILED DESCRIPTION OF INVENTION

In a first stage 2, the two-stage servo-valve 1 contains four flow resistances 3,4,5,6 which are arranged in a bridge circuit 7. The flow resistances 5 and 6 are designed as piezo-valves and are inversely variable by means of an electrical control voltage dU. The bridge circuit 7 is connected to an air inlet Pz and/or to an air outlet E at two opposite switching points 8, 9. A differential pressure of variable size and sign is provided at both other switching points 10 and 11. This differential pressure allows a control piston 13 arranged in a second stage 12 of the servo-valve 1 to be displaced, said control piston controlling a three-way valve 16 interposed between the air inlet and air outlet Pz, E and the drive 14 of a process valve 15. At both end positions of the three-way valve 16, the drive 14 is either connected to the air inlet Pz or to the air outlet E and thus shifts the process valve 15 to "close" or "open". In the center position (rest position) of the three-way valve 16, the drive 14 is separated from the air inlet and/or air outlet Pz E, and remains in the current position in each instance.

To ensure that the three-way valve 16 adopts the center position in the event of a power failure, and thus maintains the drive 14 and/or the process valve 15 in the current position, a magnetic valve 17 is arranged between the switching points 10 and 11 of the bridge circuit 7, said magnetic valve 17 being driven by the operating voltage $U_B$ and in this way being closed. In the event of an operating voltage failure, the magnetic valve 17 opens and in this way briefly pneumatically closes the switching points 10 and 11. As a consequence, the three-way valve 16 adopts its center position. The piezo valves 5, 6 and the three-way valve 16 can be embodied differently, as can be inferred for instance from the publications mentioned in the introductory part of the specification.

The invention claimed is:

1. A Two-stage servo-valve, comprising: a first stage, including four flow resistances arranged in a bridge circuit, wherein at least one flow resistance is a variable flow resistance, a first switching point connected to an air inlet and a second connected to an air outlet, and a third switching point connected to a fourth switching point via a magnetic valve, wherein a differential pressure is provided between the third and fourth switching points; and a second stage, including: a control piston actuated based upon a differential pressure between the third and fourth switching points such that the magnetic valve is closed in a driven state and open in an unconnected state, whereby the third and fourth switching points are pneumatically interconnected, and a three-way valve arranged between the air inlet and the air outlet, the three-way valve controlled via the control piston.

2. The two-stage servo valve as claimed in claim 1, wherein the first switching point is on an opposite side of the bridge circuit than the second switching point.

3. The two-stage servo valve as claimed in claim 1, wherein the differential pressure between the third and fourth switching points is of variable size and sign.

4. A Two-stage servo-valve, comprising:

a first stage having a bridge circuit, the bridge circuit having:

a first branch with a plurality of flow resistances, a second branch with a plurality of flow resistances, wherein at least one flow resistance is variable, and a bridge having a control piston and in parallel a magnetic valve, a pair of switching points connected to an inlet and to an outlet; and a second stage, having a three-way valve controlled via the control piston.

5. The two-stage servo valve as claimed in claim 4, wherein the magnetic valve is closed in a driven state and open in an unconnected state.

6. The two-stage servo valve as claimed in claim 5, wherein the two-stage servo valve is a pneumatic valve.

* * * * *